US010584600B2

(12) United States Patent
Kittleson

(10) Patent No.: US 10,584,600 B2
(45) Date of Patent: Mar. 10, 2020

(54) CERAMIC MATRIX COMPOSITE (CMC) BLADE AND METHOD OF MAKING A CMC BLADE

(71) Applicant: GENERAL ELECTRIC COMPANY, Schenectady, NY (US)

(72) Inventor: Jacob John Kittleson, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 296 days.

(21) Appl. No.: 15/622,330

(22) Filed: Jun. 14, 2017

(65) Prior Publication Data

US 2018/0363479 A1 Dec. 20, 2018

(51) Int. Cl.
*F01D 5/30* (2006.01)
*F01D 5/14* (2006.01)

(52) U.S. Cl.
CPC ..... *F01D 5/3007* (2013.01); *F01D 5/141* (2013.01); *F01D 5/3084* (2013.01); *F05D 2220/32* (2013.01); *F05D 2240/90* (2013.01); *F05D 2260/30* (2013.01); *F05D 2300/6033* (2013.01)

(58) Field of Classification Search
CPC ..... F01D 5/3007; F01D 5/3084; F01D 5/14; F01D 5/141; F01D 5/147; F01D 5/282; F01D 5/284
See application file for complete search history.

(56) References Cited

U.S. PATENT DOCUMENTS 3,986,793 A * 10/1976 Warner ..... B23P 6/002 416/212 A
4,621,979 A 11/1986 Zipps et al.
5,067,876 A 11/1991 Moreman, III
7,878,763 B2 * 2/2011 Keith ..... F01D 5/147 416/193 A
2003/0049131 A1 * 3/2003 Murakami ..... F01D 5/141 416/241 R
2004/0062651 A1 * 4/2004 Suciu ..... F01D 5/141 416/219 R
2010/0135812 A1 * 6/2010 Cairo ..... B23P 6/005 416/223 A
2012/0014802 A1 * 1/2012 Krikunov ..... F01D 5/3007 416/219 R
2012/0163978 A1 * 6/2012 Darkins, Jr. ..... F01D 5/147 416/179

(Continued)

*Primary Examiner* — Erick R Solis
*Assistant Examiner* — Anthony L Bacon
(74) *Attorney, Agent, or Firm* — McNees Wallace & Nurick LLC

(57) ABSTRACT

A ceramic matrix composite (CMC) turbine blade includes an airfoil, a hub extending from the airfoil, and a shank extending from the hub. The airfoil includes a leading edge, a trailing edge, a pressure side, and a suction side. The shank includes a dovetail root having a dovetail path curved in a radial plane. In some embodiments, a leading shank length of the shank at the leading edge and a trailing shank length of the shank at the trailing edge are greater than an intermediate shank length at an intermediate location between the leading edge and the trailing edge. At least one of the airfoil, the hub, and the shank is formed from a CMC. A method of forming the CMC turbine blade includes forming the dovetail root to have a dovetail path curved in a radial plane.

18 Claims, 4 Drawing Sheets

(56) References Cited

U.S. PATENT DOCUMENTS

| | | | | |
|---|---|---|---|---|
| 2014/0255187 | A1* | 9/2014 | Rivers | F01D 5/14<br>416/1 |
| 2015/0292336 | A1* | 10/2015 | Hui | B23P 15/04<br>416/219 R |
| 2016/0040541 | A1* | 2/2016 | Cosby | F01D 5/141<br>416/219 R |
| 2016/0222800 | A1* | 8/2016 | Kleinow | F01D 5/22 |
| 2017/0292383 | A1* | 10/2017 | Thomas | F01D 5/18 |
| 2018/0094529 | A1* | 4/2018 | Marra | F01D 5/14 |

* cited by examiner

CERAMIC MATRIX COMPOSITE (CMC) BLADE AND METHOD OF MAKING A CMC BLADE

FIELD OF THE INVENTION

The present embodiments are directed to ceramic matrix composite (CMC) blades and methods of forming CMC blades. More specifically, the present embodiments are directed to CMC blades including a dovetail root with a profile curved in a radial plane.

BACKGROUND OF THE INVENTION

The manufacture of a ceramic matrix composite (CMC) part typically includes laying up pre-impregnated composite fibers having a matrix material already present (prepreg) to form the geometry of the part (pre-form), autoclaving and burning out the pre-form, infiltrating the burned-out pre-form with the melting matrix material, and any machining or further treatments of the pre-form. Infiltrating the pre-form may include depositing the ceramic matrix out of a gas mixture, pyrolyzing a pre-ceramic polymer, chemically reacting elements, sintering, generally in the temperature range of 925 to 1650° C. (1700 to 3000° F.), or electrophoretically depositing a ceramic powder. With respect to turbine airfoils, the CMC may be located over a metal spar to form only the outer surface of the airfoil.

Examples of CMC materials include, but are not limited to, carbon-fiber-reinforced carbon (C/C), carbon-fiber-reinforced silicon carbide (C/SiC), silicon-carbide-fiber-reinforced silicon carbide (SiC/SiC), alumina-fiber-reinforced alumina ($Al_2O_3/Al_2O_3$), or combinations thereof. The CMC may have increased elongation, fracture toughness, thermal shock, dynamic load capability, and anisotropic properties as compared to a monolithic ceramic structure.

Conventional mid-span, damper-style turbine blades typically do not require significant shank height due to damping criteria, and the shank length is conventionally targeted to be around 10% of the overall blade length, regardless of the material out of which the blade is made.

Decreasing the shank length on a CMC blade may have two negative side effects, namely increasing the local interlaminar tension (ILT) and causing drastic ply drop regions, which are typically prone to defects. A longer shank improves the ply drop transition at the leading edge (LE) and the trailing edge (TE) of the hub of the CMC blade, but lengthening the dovetail shank results in greater material usage and may be prohibitive in the case of CMC blades.

BRIEF DESCRIPTION OF THE INVENTION

In an embodiment, a ceramic matrix composite (CMC) turbine blade includes an airfoil, a hub extending from the airfoil; and a shank extending from the hub. The airfoil includes a leading edge, a trailing edge opposite the leading edge, a pressure side extending from the leading edge to the trailing edge, and a suction side extending from the leading edge to the trailing edge opposite the pressure side. The shank includes a dovetail root having a dovetail path curved in a radial plane. At least one of the airfoil, the hub, and the shank is formed from a CMC.

In another embodiment, a method of forming a ceramic matrix composite (CMC) turbine blade includes forming the dovetail root to have a dovetail path curved in a radial plane. The CMC turbine blade includes an airfoil, a hub extending from the airfoil, and a shank extending from the hub. The airfoil has a leading edge, a trailing edge opposite the leading edge, a pressure side extending from the leading edge to the trailing edge, and a suction side extending from the leading edge to the trailing edge opposite the pressure side. At least one of the airfoil, the hub, and the shank is formed from a CMC.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
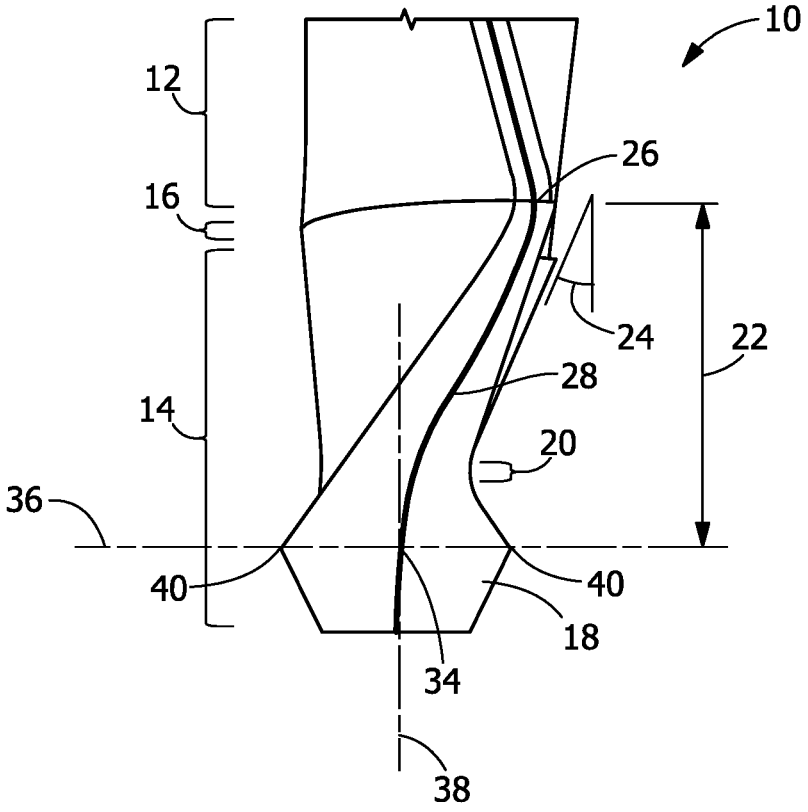
FIG. 1 is an end view of a ceramic matrix composite (CMC) blade including a dovetail root with a straight dovetail path.

Provided is a ceramic matrix composite (CMC) blade including a dovetail root with a profile curved in a radial plane and a method of forming a CMC blade.

Embodiments of the present disclosure, for example, in comparison to concepts failing to include one or more of the features disclosed herein, reduce material usage in a CMC blade, provide a smoother transition at a hub between the airfoil and the dovetail root of a CMC blade, provide a CMC blade with leading edge (LE) and trailing edge (TE) shank lengths greater than an intermediate shank length, provide a CMC blade with a dovetail root profile curved in a radial plane, provide a CMC blade with a dovetail root profile curved in both a radial plane and an axial plane, or combinations thereof.

A blade midplane, as used herein, refers to a contour line from the bottom of the dovetail root to the tip of the airfoil, where the contour line is located midway between the pressure side surface and the suction side surface of the CMC airfoil.

A hub, as used herein, refers to a transition region between the shank of a CMC blade and an airfoil of the CMC blade. In some embodiments, the hub is at an inflection point where the contour of the blade midplane of the CMC blade changes directions. The hub may alternatively be referred to as the 0% span.

A narrowed neck region, as used herein, refers to a region of reduced thickness in the shank of a CMC blade above the dovetail root.

A dovetail path, as used herein, refers to a path followed by the midplane point, midway between the end lines of the dovetail root, follows along the width of the CMC blade from the leading edge to the trailing edge.

A shank length, as used herein, refers to the length of the shank measured from the end line of the pressure side to the hub.

An end line, as used herein, refers to a line from the leading edge to the trailing edge along the widest section of the dovetail root. One end line is on the pressure side and the other is on the suction side of the CMC blade.

A leading shank length, as used herein, refers to the length of the shank measured from the end line of the pressure side to the hub at the leading edge end of the CMC blade.

A trailing shank length, as used herein, refers to the length of the shank measured from the end line of the pressure side to the hub at the trailing edge end of the CMC blade.

An intermediate shank length, as used herein, refers to the length of the shank measured from the end line of the pressure side to the hub at an intermediate location between the leading edge end and the trailing edge of the CMC blade. In some embodiments, the intermediate shank length is measured at a point midway between the leading edge and the trailing edge of the CMC blade. In some embodiments, the intermediate shank length is measured at a location between the leading edge end and the trailing edge of the CMC blade where the value of the shank length is the minimum value for the CMC blade.

A contour angle, as used herein, refers to the angle between a radial plane and the blade midplane line midway between the dovetail path and the hub inflection point.

Referring to FIG. 1, the ceramic matrix composite (CMC) blade 10 includes an airfoil 12 and a shank 14 separated by a hub 16. The shank 14 includes a dovetail root 18 and a narrowed neck portion 20 above the dovetail root 18. The contour of the airfoil 12 causes a curvature of the hub 16 of the CMC blade 10. The relatively short shank length 22 of the shank 14, in combination with the contour of the airfoil 12 causing a curvature of the hub 16, leads to a relatively large contour angle 24 and a relatively sharp hub inflection point 26 of the blade midplane 28 at the leading edge 30 and the trailing edge 32 (see FIG. 3) of the hub 16. The dovetail path 34 of the CMC blade 10 of FIG. 1 follows the intersection of an axial plane 36 and a radial plane 38 intersecting the end lines 40 of the dovetail root 18 at the leading edge 30 and the trailing edge 32 (see FIG. 3) of the CMC blade 10. The CMC blade 10 has a substantially-constant shank length 22 from the leading edge 30 to the trailing edge 32 of the CMC blade 10 (see FIG. 3). In some embodiments, the total blade length of the CMC blade 10 is about 112 cm (about 44 in.) or at least about 112 cm (about 44 in.).

Figure 2:
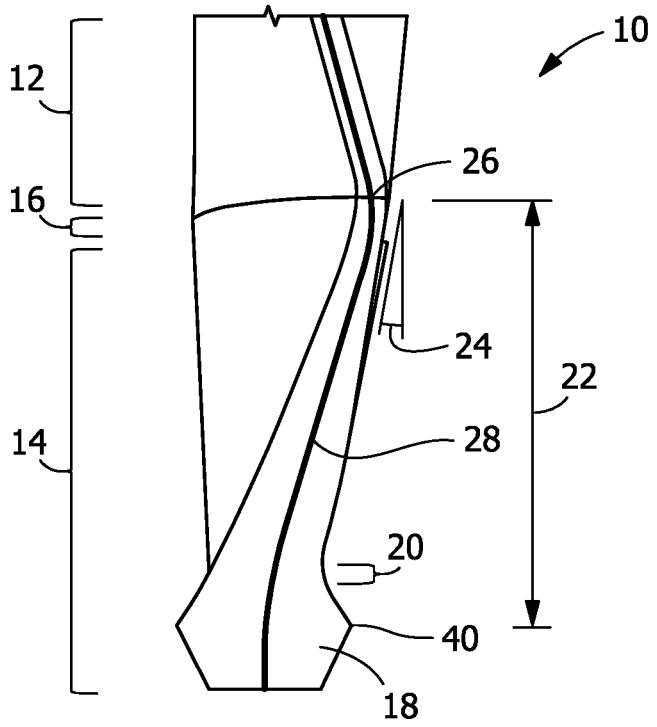
FIG. 2 is an end view of another CMC blade including a dovetail root with a straight dovetail path.

Referring to FIG. 2, the CMC blade 10 includes an airfoil 12 and a shank 14 separated by a hub 16. The dovetail path 34 of the CMC blade 10 of FIG. 2 follows the intersection of an axial plane 36 and a radial plane 38 intersecting the end lines 40 (see FIG. 1) of the dovetail root 18 at the leading edge 30 and the trailing edge 32 (see FIG. 3) of the CMC blade 10. The CMC blade 10 of FIG. 2 has a greater shank length 22 than the CMC blade 10 of FIG. 1. Increasing the shank length 22 of the shank 14 provides a smoother transition of the blade midplane 28 at the leading edge 30 and trailing edge 32 of the hub 16. In one case, the CMC blades of FIG. 1 and FIG. 2 have substantially the same airfoils 12, but the shank length 22 of the CMC blade 10 of FIG. 2 is about 15.2 cm (about 6 in.), whereas the shank length 22 of the CMC blade 10 of FIG. 1 is about 10.2 cm (about 4 in.). The smoother transition at the hub inflection point 26 and the relatively smaller contour angle 24 for the CMC blade 10 of FIG. 2 come at a cost, however, of a larger shank 14, and hence a greater amount and volume of material than for the CMC blade 10 of FIG. 1. In one case, the increase of the shank length 22 from about 10.2 cm (about 4 in.) to about 15.2 cm (about 6 in.), along the width of the blade from the leading edge 30 to the trailing edge 32 (see FIG. 3), increases the total volume of the CMC blade 10 by about 16%.

Figure 3:
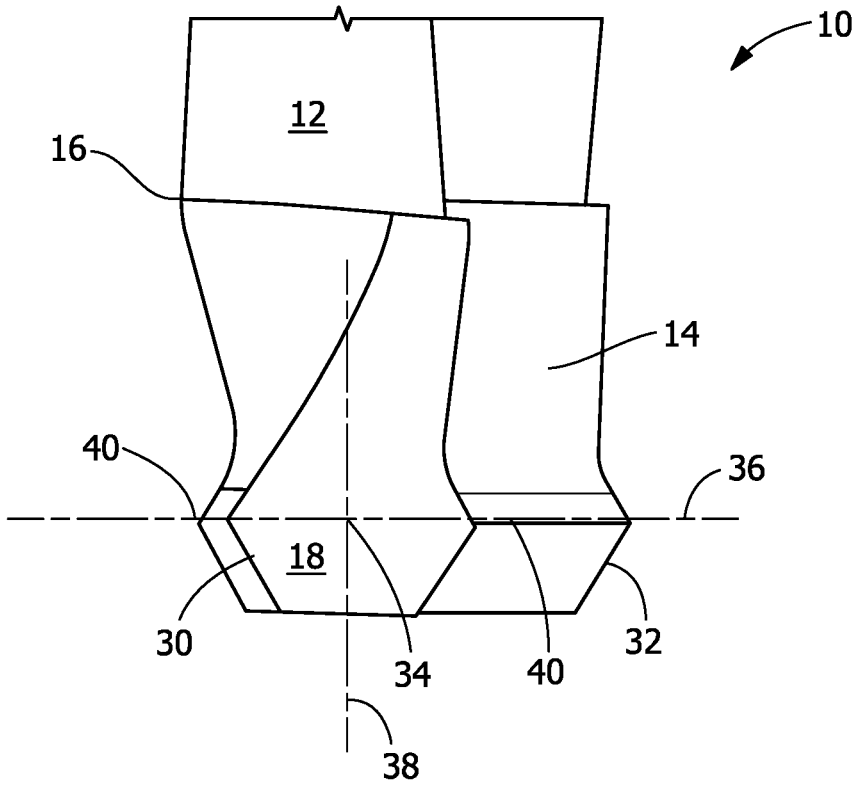
FIG. 3 is a partial perspective view of a CMC blade including a dovetail root with a dovetail path curved only in the axial plane.

Referring to FIG. 3, the CMC blade 10 includes an airfoil 12 and a shank 14 separated by a hub 16. The dovetail path 34 of the dovetail root 18 is curved in the axial plane 36 but not in the radial plane 38 and has a substantially-constant shank length 22 from the leading edge 30 to the trailing edge 32 of the CMC blade 10, both of which are visible in FIG. 3.

Figure 4:
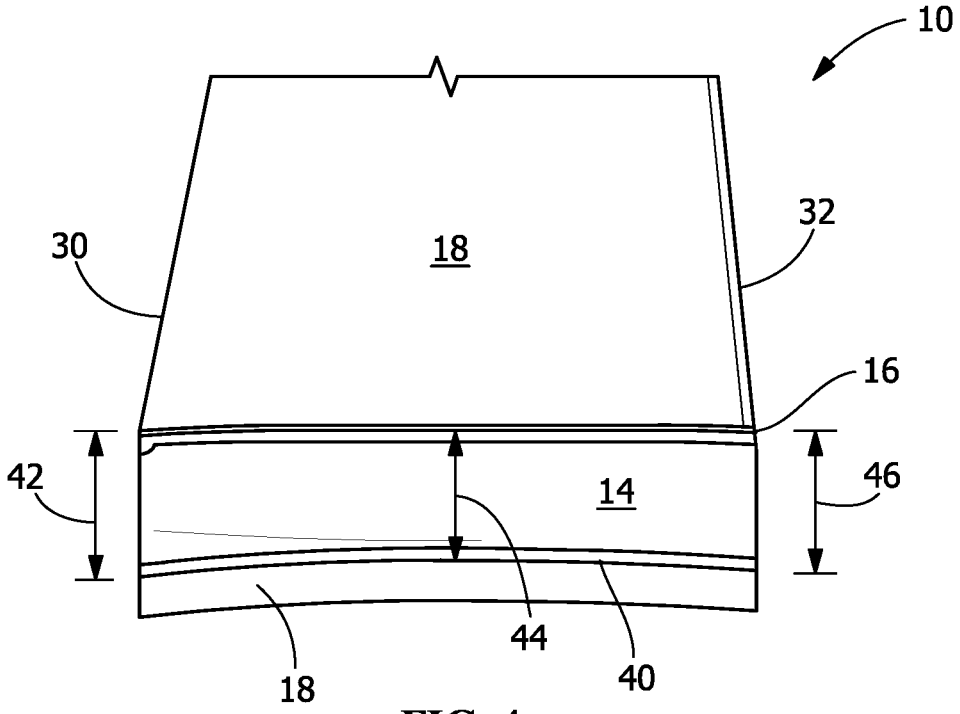
FIG. 4 is a pressure side view of a CMC blade with a dovetail path curved in the radial plane in an embodiment of the present disclosure.

Referring to FIG. 4, the CMC blade 10 includes an airfoil 12 and a shank 14 separated by a hub 16. The dovetail path 34 of the dovetail root 18 is curved in the radial plane 38 (see FIG. 5). Providing a dovetail root 18 with a dovetail path 34 curved in the radial plane 38 reduces the volume of material for the shank 14, and hence the CMC blade 10, relative to the shank 14 and the CMC blade 10 of FIG. 1, while still providing smoother transitions for the hub inflection point 26 (see FIG. 3) at the leading edge 30 and the trailing edge 32 of the hub 16. The hub 16 still lies substantially in a plane parallel to the axial plane 36, but the dovetail path 34, and hence the base of the dovetail root 18, has a downward concave curvature in the radial plane 38 such that the CMC blade 10 has an intermediate shank length 44 that is less than the leading shank length 42 and the trailing shank length 46. In one case, the intermediate shank length 44 is about 10.2 cm (about 4 in.) and the leading shank length 42 and trailing shank length 46 are about 12.7 cm (about 5 in.), resulting in a reduction in total volume of the CMC blade 10 of about 3% to about 7% relative to a CMC blade 10 having an identical airfoil 12 but a dovetail path 34 following the intersection of the axial plane 36 and the radial plane 38 and a shank length 22 of about 12.7 cm (about 5 in.) along the width of the blade from the leading edge 30 to the trailing edge 32.

Still referring to FIG. 4, the trailing shank length 46 of the trailing edge 32 may be substantially greater than the leading shank length 42 of the leading edge 30 in some embodiments. This allows the hub inflection point 26 of the trailing edge 32 to be smoother and the contour angle 24 at the trailing edge 32 to be decreased. Such an arrangement may be beneficial especially on later stage blades, as the longer the hub 16 chord is, the more airflow turning the trailing edge 32 does. Consequentially, the trailing edge 32 is more overhung than the leading edge 30, as may be seen in FIG. 1. In such embodiments, the CMC blade 10 has a trailing shank length 46 that, in comparison to the leading shank length 42, is greater by at least about 1%, alternatively about 1%, alternatively in the range of about 1% to about 5%, alternatively at least about 3%, alternatively about 3%, alternatively at least about 5%, alternatively about 5%, alternatively in the range of about 1% to about 10%, alternatively in the range of about 5% to about 10%, alternatively at least about 10%, or any value, range, or sub-range therebetween.

Figure 5:
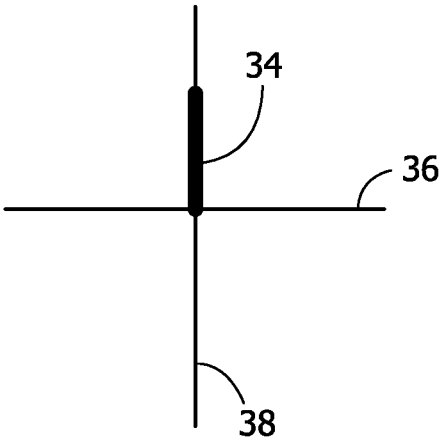
FIG. 5 is a schematic end view of a dovetail path of a CMC blade curved in the radial plane.
Figure 6:
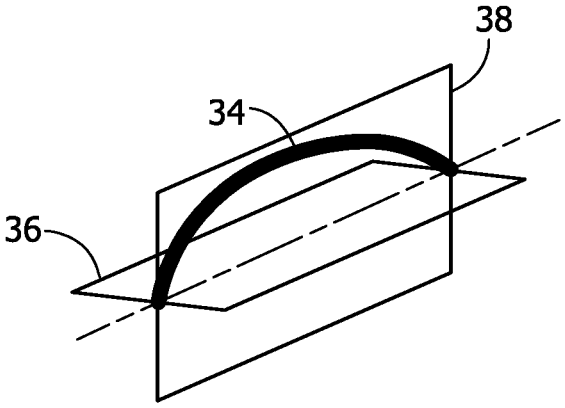
FIG. 6 is a schematic perspective view of the dovetail path of FIG. 5.

FIG. 5 shows an end view of the dovetail path 34 of a dovetail root 18 that is curved in the radial plane 38. The dovetail path 34 lies in the radial plane 38. As shown in FIG. 6, the dovetail path 34 may have an arcuate shape in the radial plane 38. In some embodiments, the arcuate shape has a constant or substantially constant radius.

Figure 7:
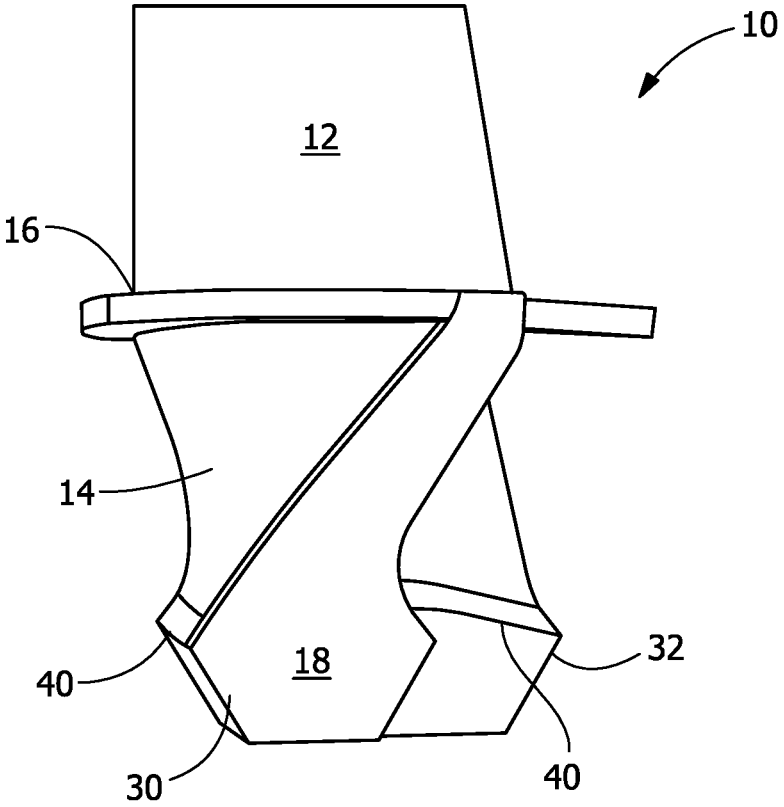
FIG. 7 is a schematic end view of a dovetail path of a CMC blade curved in the axial plane and in the radial plane.

Referring to FIG. 7, the CMC blade 10 includes an airfoil 12 and a shank 14 separated by a hub 16. The dovetail path 34 of the dovetail root 18 is curved in a tilted plane 48 (see FIG. 9) that shares a common line of intersection with the axial plane 36 and the radial plane 38 but is angled with respect to both the axial plane 36 and the radial plane 38. In other words, the dovetail path 34 is curved with respect to both the axial plane 36 and the radial plane 38. Providing a dovetail root 18 with a dovetail path 34 curved in both the axial plane 36 and the radial plane 38 reduces the volume of material for the shank 14, and hence the CMC blade 10, relative to the shank 14 and the CMC blade 10 of FIG. 1, while still providing smoother transitions for the hub inflection point 26 (see FIG. 3) at the leading edge 30 and the trailing edge 32 of the hub 16. The hub 16 still lies substantially in a plane parallel to the axial plane 36, but the dovetail path 34, and hence the base of the dovetail root 18, has a downward concave curvature in the radial plane 38 such that the CMC blade 10 has an intermediate shank length 44 that is less than the leading shank length 42 and the trailing shank length 46 (see FIG. 4).

Figure 8:
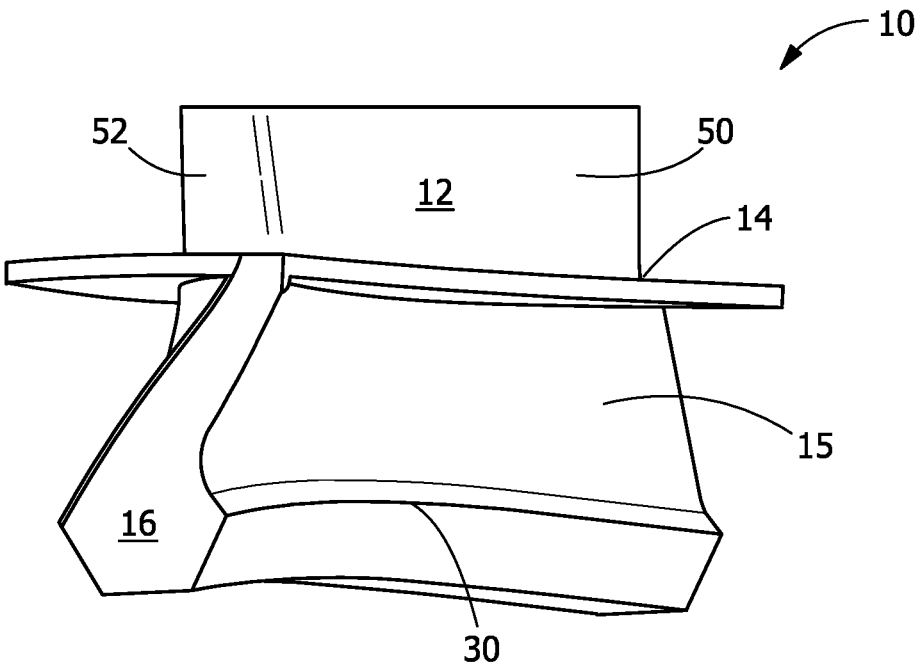
FIG. 8 is a schematic perspective view of the dovetail path of FIG. 7.

Referring to FIG. 8, the curvature of the dovetail path 34 in the axial plane 36 is concave on the pressure side 50 of the airfoil 12 and convex on the suction side 52 of the airfoil 12.

Figure 9:
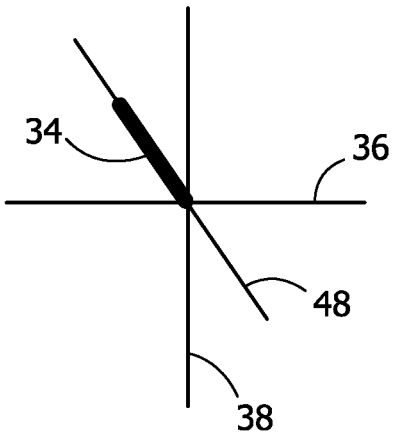
FIG. 9 is an end view of a CMC blade with a dovetail path curved in the radial plane and the axial plane in an embodiment of the present disclosure.
Figure 10:
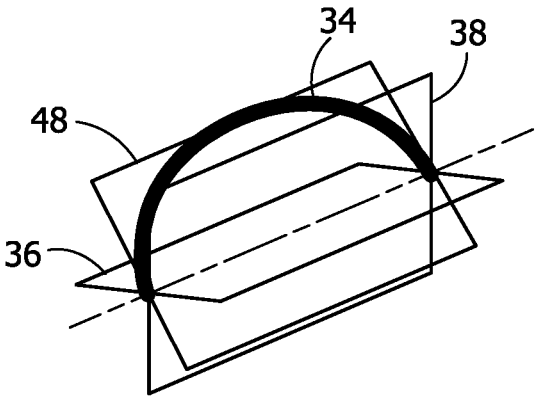
FIG. 10 is a perspective view of the CMC blade of FIG. 9.

FIG. 9 shows an end view of the dovetail path 34 of a dovetail root 18 that is curved in a tilted plane 48 at a first plane angle with respect to the axial plane 36 and at a second plane angle with respect to the radial plane 38. The dovetail path 34 lies in this tilted plane 48. As shown in FIG. 10, the dovetail path 34 may have an arcuate shape in the tilted plane 48. In some embodiments, the arcuate shape has a constant or substantially constant radius. The projections of the dovetail path 34 onto the axial plane 36 and the radial plane 38 are both curved as well.

In some embodiments, the profile of the dovetail root 18 does not taper along the length of the CMC blade 10 from the leading edge 30 to the trailing edge 32 or from the trailing edge 32 to the leading edge 30. In some embodiments, the profile of the dovetail root 18 is constant or substantially constant along the length of the CMC blade 10 from the leading edge 30 to the trailing edge 32.

In some embodiments, the shank length 22 is controlled in the axial direction by a radial curvature of the dovetail path 34 of the dovetail root 18 in a radial plane 38 from the leading edge 30 to the trailing edge 32 of the CMC blade 10. The radial curvature allows a local increase of the shank length 22 at the leading edge 30 and the trailing edge 32 of the CMC blade 10, thereby providing a smoother CMC ply transition at the hub 16.

In some embodiments, the dovetail root 18 is curved on a tilted plane 48 that is tilted at an angle to an orientation between that of the axial plane 36 and the radial plane 38.

Striking a balance between a short shank 14 and a long shank 14 may be achieved and taken to entitlement by locally increasing the shank length 22 at the leading edge 30 and the trailing edge 32 of the CMC blade 10.

By reducing the material of each CMC blade 10, a sizable amount of overall material is saved on the engine set and therefore a large reduction in unit cost may be achieved.

In some embodiments, the dovetail root 18 is curved in the axial plane 36 and in the radial plane 38. There is a limited value for a long shank 14 for damping due to a mid-span damper. To ease the CMC ply transition to the hub 16 at the leading edge 30 and the trailing edge 32 of the CMC blade 10, the shank 14 is locally lengthened forward and aft. The radial curvature reduces the CMC material usage.

In comparison with a similar CMC blade 10 having a dovetail root 18 with a dovetail path 34 that is not curved in the radial plane 38, the CMC blade 10, having a dovetail root 18 with a dovetail path 34 that is curved in the radial plane 38 with a leading shank length 42 and a trailing shank length 46 equal to the shank length 22 of the similar CMC blade 10, has a reduction in total volume, relative to the similar CMC blade 10, in the range of about 2% to about 8%, alternatively at least about 2%, alternatively in the range of about 3% to about 7%, alternatively at least about 3%, alternatively at least about 5%, or any value, range, or sub-range therebetween.

The CMC blade 10 has a leading shank length 42 that, in comparison to the intermediate shank length 44, is greater by at least about 10%, alternatively about 10%, alternatively in the range of about 10% to about 15%, alternatively at least about 15%, alternatively about 15%, alternatively in the range of about 15% to about 20%, alternatively in the range of about 10% to about 20%, alternatively at least about 20%, or any value, range, or sub-range therebetween.

The CMC blade 10 has a trailing shank length 46 that, in comparison to the intermediate shank length 44, is greater by at least about 10%, alternatively about 10%, alternatively in the range of about 10% to about 15%, alternatively at least about 15%, alternatively about 15%, alternatively in the range of about 15% to about 20%, alternatively in the range of about 10% to about 20%, alternatively at least about 20%, or any value, range, or sub-range therebetween.

The CMC blade 10 has a contour angle 24 at the leading edge 30 that, in comparison to a contour angle 24 at the leading edge 30 of a similar CMC blade 10 having a shank length 22 equal to the intermediate shank length 44 of the CMC blade 10 but a dovetail path 34 that is not curved in the radial plane 38, is less by at least about 10%, alternatively about 10%, alternatively in the range of about 10% to about 20%, alternatively at least about 20%, alternatively about 15%, alternatively in the range of about 20% to about 30%, alternatively in the range of about 10% to about 30%, alternatively at least about 30%, or any value, range, or sub-range therebetween.

The CMC blade 10 has a contour angle 24 at the trailing edge 32 that, in comparison to a contour angle 24 at the trailing edge 32 of a similar CMC blade 10 having a shank length 22 equal to the intermediate shank length 44 of the CMC blade 10 but a dovetail path 34 that is not curved in the radial plane 38, is less by at least about 10%, alternatively about 10%, alternatively in the range of about 10% to about 20%, alternatively at least about 20%, alternatively about 20%, alternatively in the range of about 20% to about 30%, alternatively in the range of about 10% to about 30%, alternatively at least about 30%, or any value, range, or sub-range therebetween.

The leading shank length 42 as a percentage of the full length of the CMC blade 10 is about 10%, alternatively at least about 10%, alternatively in the range of about 5% to about 15%, alternatively in the range of about 6% to about 14%, alternatively in the range of about 8% to about 12%, alternatively in the range of about 9% to about 11%, or any value, range, or sub-range therebetween.

The trailing shank length 46 as a percentage of the full length of the CMC blade 10 is about 10%, alternatively at least about 10%, alternatively in the range of about 5% to about 15%, alternatively in the range of about 6% to about 14%, alternatively in the range of about 8% to about 12%, alternatively in the range of about 9% to about 11%, or any value, range, or sub-range therebetween.

The CMC blade 10 may be made using any ceramic matrix composite materials and any CMC fabrication process. In some embodiments, at least a portion of at least one of the airfoil, the hub, and the shank is formed from a CMC. In some embodiments, at least one of the airfoil, the hub, and the shank is formed from a CMC. In some embodiments, most, all, or substantially all of the airfoil, the hub, and the shank is formed from a CMC. In some embodiments, the CMC blade 10 is monolithic, with the airfoil 12 and hub 16 being integral, and the hub 16 and shank 14 being integral.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A ceramic matrix composite (CMC) turbine blade comprising:

an airfoil having an airfoil leading edge, an airfoil trailing edge opposite the airfoil leading edge, a pressure side extending from the airfoil leading edge to the airfoil trailing edge, and a suction side extending from the airfoil leading edge to the airfoil trailing edge opposite the pressure side;

a hub extending from the airfoil; and a shank extending from the hub and having a shank leading edge and a shank trailing edge, the shank comprising a dovetail root having a dovetail path curved in a radial plane;

wherein at least one of the airfoil, the hub, and the shank is formed from a CMC; and wherein a leading shank length of the shank at the shank leading edge and a trailing shank length of the shank at the shank trailing edge are greater than an intermediate shank length of the shank at an intermediate location between the shank leading edge and the shank trailing edge.

2. The CMC turbine blade of claim 1, wherein the leading shank length is at least about 10% greater than the intermediate shank length.

3. The CMC turbine blade of claim 1, wherein the trailing shank length is at least about 10% greater than the intermediate shank length.

4. The CMC turbine blade of claim 1, wherein the leading shank length being greater than the intermediate shank length reduces a contour angle between the shank and hub at the shank leading edge relative to a comparative CMC turbine blade having a comparative leading shank length equal to the intermediate shank length.

5. The CMC turbine blade of claim 1, wherein the trailing shank length being greater than the intermediate shank length reduces a contour angle between the shank and the hub at the shank trailing edge relative to a comparative CMC turbine blade having a comparative trailing shank length equal to the intermediate shank length.

6. The CMC turbine blade of claim 1, wherein the trailing shank length is greater than the leading shank length.

7. The CMC turbine blade of claim 1, wherein the dovetail path has an arcuate shape having a constant radius.

8. The CMC turbine blade of claim 1, wherein the dovetail root is a single dovetail.

9. The CMC turbine blade of claim 1, wherein the dovetail path of the dovetail root is also curved in an axial plane perpendicular to the radial plane.

10. The CMC turbine blade of claim 9, wherein the dovetail path has an arcuate shape having a constant radius.

11. A method of forming a ceramic matrix composite (CMC) turbine blade comprising an airfoil, a hub extending from the airfoil, and a shank extending from the hub, the airfoil having an airfoil leading edge, an airfoil trailing edge opposite the airfoil leading edge, a pressure side extending from the airfoil leading edge to the airfoil trailing edge, and a suction side extending from the airfoil leading edge to the airfoil trailing edge opposite the pressure side, the method comprising forming the dovetail root to have a shank leading edge, a shank trailing edge, a dovetail path curved in a radial plane, and a leading shank length of the shank at the shank leading edge and a trailing shank length of the shank at the shank trailing edge to be greater than an intermediate shank length of the shank at an intermediate location between the shank leading edge and the shank trailing edge, wherein at least one of the airfoil, the hub, and the shank is formed from a CMC.

12. The method of claim 11, wherein the forming comprises radially contouring the dovetail root from the shank leading edge to the shank trailing edge to locally increase the leading shank length and the trailing shank length with respect to the intermediate shank length.

13. The method of claim 12, wherein radially contouring the dovetail root reduces a contour angle between the shank and the hub at the shank leading edge relative to a comparative CMC turbine blade having a comparative leading shank length equal to the intermediate shank length by about 10% or more.

14. The method of claim 12, wherein radially contouring the dovetail root reduces a contour angle between the shank and the hub at the shank trailing edge relative to a comparative CMC turbine blade having a comparative trailing shank length equal to the intermediate shank length by about 10% or more.

15. The method of claim 11, wherein the leading shank length is at least about 10% greater than the intermediate shank length.

16. The method of claim 11, wherein the trailing shank length is at least about 10% greater than the intermediate shank length.

17. The method of claim 11, wherein the forming further comprises forming the dovetail root to have the dovetail path also curved in an axial plane perpendicular to the radial plane.

18. The method of claim 11, wherein the dovetail path has an arcuate shape having a constant radius.

* * * * *